US009687398B2

(12) United States Patent
Akesson et al.

(10) Patent No.: US 9,687,398 B2
(45) Date of Patent: Jun. 27, 2017

(54) SHOWER STRETCHER

(75) Inventors: Bodil Akesson, Malmo (SE); Kajsa Haraldsson, Malmo (SE); Andreas Thomasson, Sjobo (SE); Mats Edberg, Eslov (SE); Richard Nilsson, Lund (SE)

(73) Assignee: ARJO HOSPITAL EQUIPMENT AB (SE)

( * ) Notice: Subject to any disclaimer, the term of this patent is extended or adjusted under 35 U.S.C. 154(b) by 990 days.

(21) Appl. No.: 13/497,732

(22) PCT Filed: Sep. 16, 2010

(86) PCT No.: PCT/EP2010/063601

§ 371 (c)(1),
(2), (4) Date: Jun. 13, 2012

(87) PCT Pub. No.: WO2011/036085

PCT Pub. Date: Mar. 31, 2011

(65) Prior Publication Data

US 2012/0255115 A1 Oct. 11, 2012

(30) Foreign Application Priority Data

Sep. 23, 2009 (EP) ..... 09171064

(51) Int. Cl.

| | |
|---|---|
| ***A47K 3/28*** | (2006.01) |
| ***A61G 7/00*** | (2006.01) |
| *A61G 7/05* | (2006.01) |

(52) U.S. Cl.

CPC .... *A61G 7/0005* (2013.01); *A61G 2007/0513* (2013.01)

(58) Field of Classification Search

CPC ..... A61H 33/00; A61G 7/0005
USPC ..... 4/604
See application file for complete search history.

(56) References Cited

U.S. PATENT DOCUMENTS

| | | | | |
|---|---|---|---|---|
| 2,834,032 | A * | 5/1958 | Scott | 5/632 |
| 3,613,127 | A | 10/1971 | Bond | |
| 4,002,330 | A * | 1/1977 | Johansson | 5/606 |
| 4,821,348 | A * | 4/1989 | Pauna | 4/547 |
| 5,285,539 | A | 2/1994 | Anderson et al. | |
| 5,588,167 | A | 12/1996 | Pahno et al. | |
| 5,678,257 | A | 10/1997 | Morcate et al. | |
| 6,421,853 | B1 * | 7/2002 | Pecorelli et al. | 5/606 |
| 2003/0121095 | A1 | 7/2003 | Argento et al. | |
| 2006/0213007 | A1 * | 9/2006 | Palay et al. | 5/81.1 R |
| 2007/0157376 | A1 * | 7/2007 | Paz et al. | 4/540 |
| 2007/0294828 | A1 | 12/2007 | Hornbach et al. | |

(Continued)

FOREIGN PATENT DOCUMENTS

| | | |
|---|---|---|
| CN | 2850597 Y | 12/2006 |
| DE | 298 02 043 | 6/1998 |

(Continued)

OTHER PUBLICATIONS

International Search Report for PCT/EP2010/063601, dated Dec. 22, 2010.

*Primary Examiner* — Tuan N Nguyen
(74) *Attorney, Agent, or Firm* — The Webb Law Firm

(57) ABSTRACT

A shower stretcher assembly including a frame which supports a platform having panels that define a back rest section, a seat section, and a foot section. The seat section is flexible and capable of conforming to the shape of a person lying thereon.

20 Claims, 5 Drawing Sheets

(56) References Cited

U.S. PATENT DOCUMENTS

| | | | | |
|---|---|---|---|---|
| 2009/0000027 | A1 | 1/2009 | Jarrett, III | |
| 2010/0005592 | A1* | 1/2010 | Poulos et al. | 5/618 |

FOREIGN PATENT DOCUMENTS

| | | | |
|---|---|---|---|
| FR | 2 788 967 | | 8/2000 |
| JP | S5637825 | A | 9/1981 |
| JP | H10155596 | A | 6/1998 |
| JP | H11267155 | A | 10/1999 |
| JP | 2000093250 | A | 4/2000 |
| JP | 2000197680 | A | 7/2000 |
| JP | 2001095885 | A | 4/2001 |
| JP | 3509574 | B2 | 3/2004 |
| JP | 2005204704 | A | 8/2005 |
| JP | 2006116173 | A | 5/2006 |
| WO | WO 88/03790 | | 6/1988 |
| WO | 98013004 | A1 | 4/1998 |
| WO | WO 98/13004 | | 4/1998 |
| WO | WO 00/21479 | | 4/2000 |

* cited by examiner

SHOWER STRETCHER

CROSS-REFERENCE TO RELATED APPLICATIONS

This application is a U.S. nationalization application, pursuant to 35 USC §317, of international patent application no. PCT/EP2010/063601, filed Sep. 16, 2010, which in turn claims priority to European Patent Application No. 09171064.0, filed on Sep. 23, 2009, each of which is incorporated by reference in their entirety.

TECHNICAL FIELD

This invention refers to a bathing or shower apparatus for bedridden patients, in particular, a shower stretcher for use in hospitals, nursing homes or like institutions.

BACKGROUND

Shower stretchers, generally have a platform onto which a patient can be transferred and a trough or similar arrangement is provided around the patient to provide both a water container and splash guard. A patient supported by the platform can then be showered. A drain is located in a depression within the platform to discharge water.

The shower stretcher saves nurses and attendants much heavy lifting when transferring patients from their beds or wheelchairs prior to and after showering. It also allows the attendant to bath a patient at a working height that is more convenient than the conventional bath. The shower stretcher therefore has useful application for long-stay patients in surgical, medical and orthopaedic wards and almost general application for geriatric patients.

The invention provides an improved stretcher for use in bathing patients.

BRIEF SUMMARY

Accordingly, the invention comprises of a bath or shower stretcher comprising a frame supporting a platform and means to raise and lower said platform. At least a part of the platform surface is flexible to conform more closely to the shape of the person lying thereon. Preferably, the platform comprises a back rest section, a seat section and a foot section. The seat section is disposed between the back rest section and the foot section. Preferably, the seat section provides a flexible surface for the patient to lie on. This flexible seat section provides a more comfortable surface for the patient to lie on, especially when on their side and allows for easier turning of the patient. The platform surface adjusts to the size and weight of the patient and when the back rest is raised, the flexible seat section prevents the patient from sliding further down the stretcher, especially in the presence of soap and water during showering.

Preferably, the stretcher includes head and foot side barriers coupled to the stretcher frame, the side barriers arranged to move between a raised position, an extended position, and a lowered position in which they lie alongside the frame so as to be below the level of the mattress of the stretcher. The extended position of the side barriers accommodates larger patients.

Preferably, the seat section has concave sides to present a waisted surface when looking from above the stretcher/to give the care giver better access to the patient and a better working position. More preferably, head and foot side barriers are provided to provide a safer experience for the patient on turning. The side barriers may have handles for manoeuvring the stretcher sideways.

BRIEF DESCRIPTION OF THE DRAWINGS

The invention will now be described by way of example only, with reference to the accompanying drawings in which.

DETAILED DESCRIPTION

Figure 1:
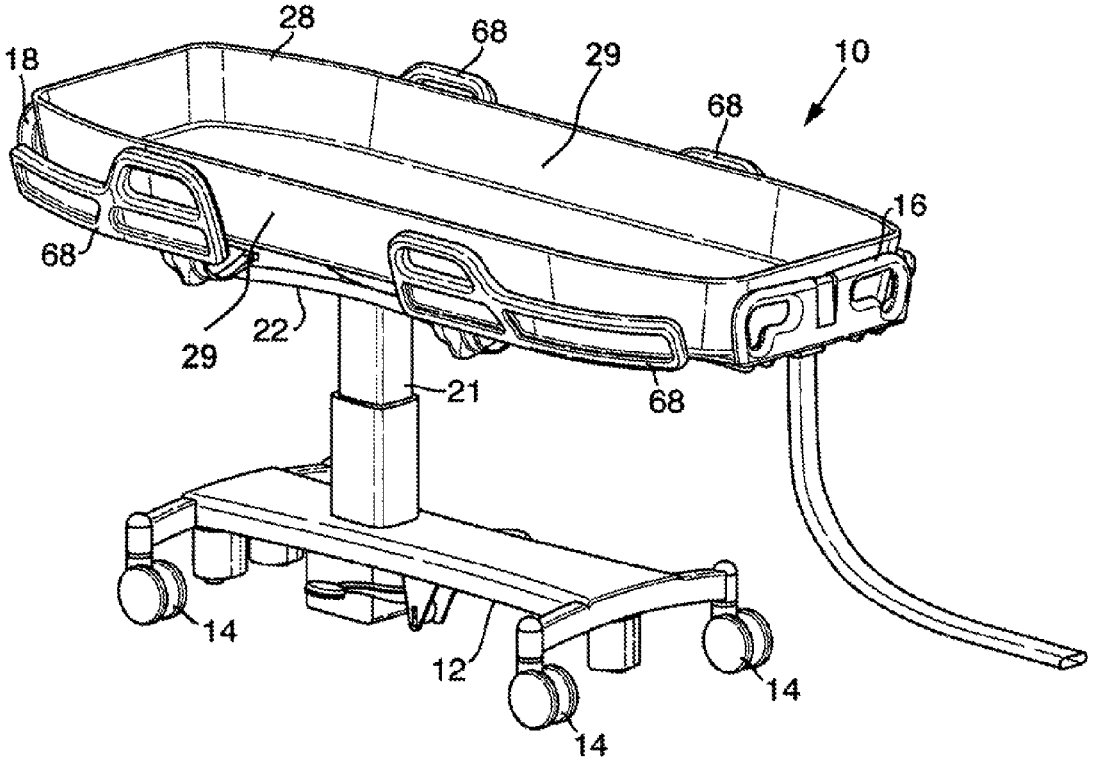
FIG. 1 is a perspective view of the shower stretcher according to the invention.

Referring to FIG. 1, there is shown a preferred embodiment of stretcher assembly 10 which includes a wheeled base 12 provided with four castors 14, a headboard 16 and footboard 18. Coupled to the base 12 is a stretcher platform 20 (not shown in FIG. 1) which can be raised and lowered relative to the base 12 by means of a column 21 of conventional type.

The platform 20 is supported on a frame 22 typically made of metal or a metal alloy and supports a thin mattress 28 of water-resistant material.

Figure 2:
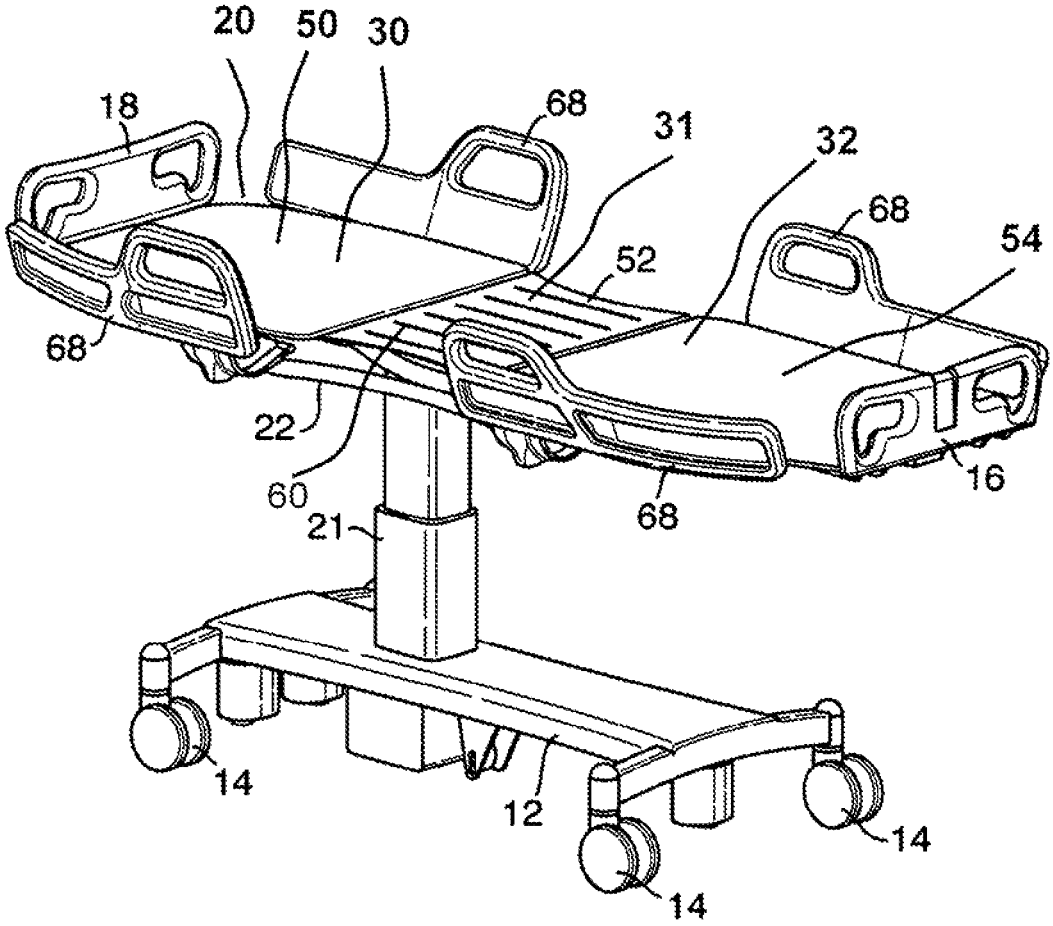
FIG. 2 is a schematic view showing the flexible surface of the platform and the side barriers in their extended position.

As shown in FIG. 2, the platform (with mattress 28 not shown) comprises three mattress support panels 50, 52, 54. These panels 50, 52, 54, form respectively the backrest section 30, seat section 31 and foot rest 32 section of the platform 20.

As can be seen in the Figures, the center mattress support panel 52 is cut away at the sides so as to present a waisted support surface when looking down on the bed platform 20. The panels 50, 52, 54 lie below the side barriers 68, preferably by a distance sufficient to allow a mattress 28 (shown in FIG. 1) placed on the panels 50, 52, 54 to fit within the side barriers 68, the mattress sides held by the substantially vertical side surfaces provided by the side barriers 68. As shown in FIG. 2, side barriers 68 may comprise head and foot side barriers and may extend along the sides of support panel 50 and support panel 54, but not support panel 52.

Figure 4:
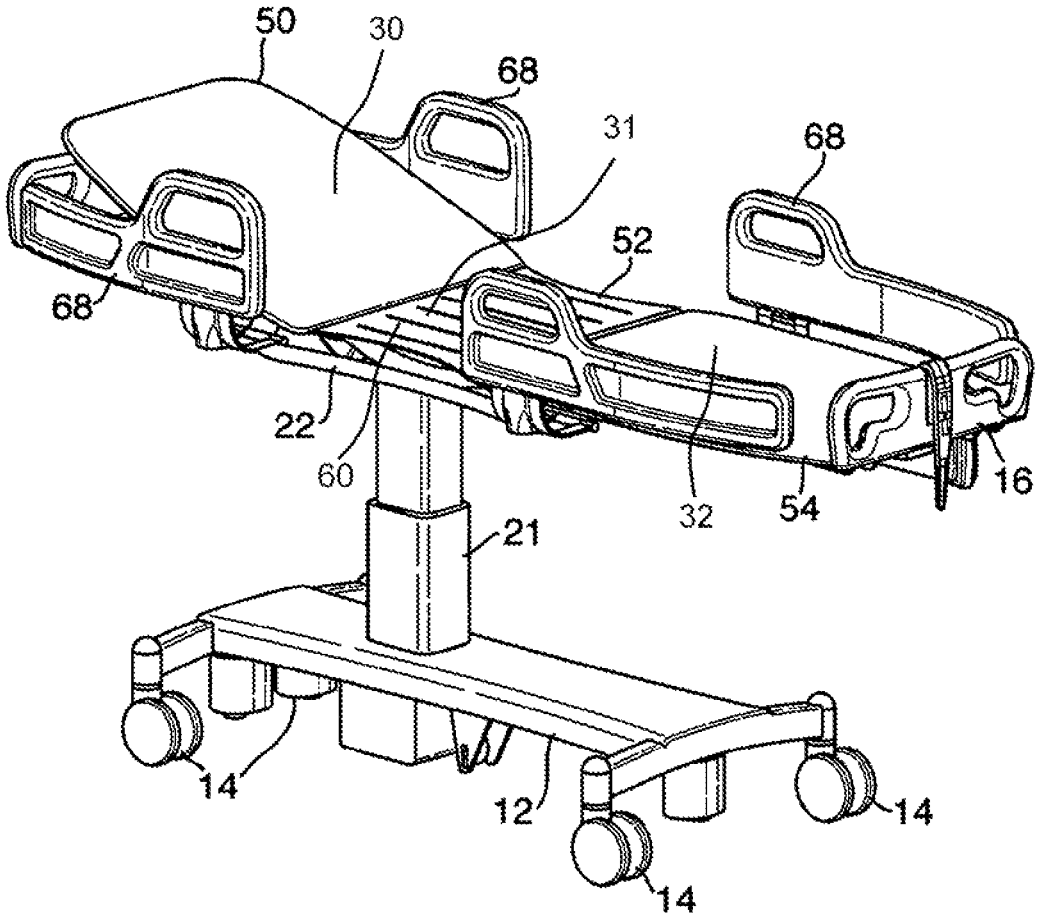
FIG. 4 is a schematic view of the stretcher with the back rest raised.
Figure 5:
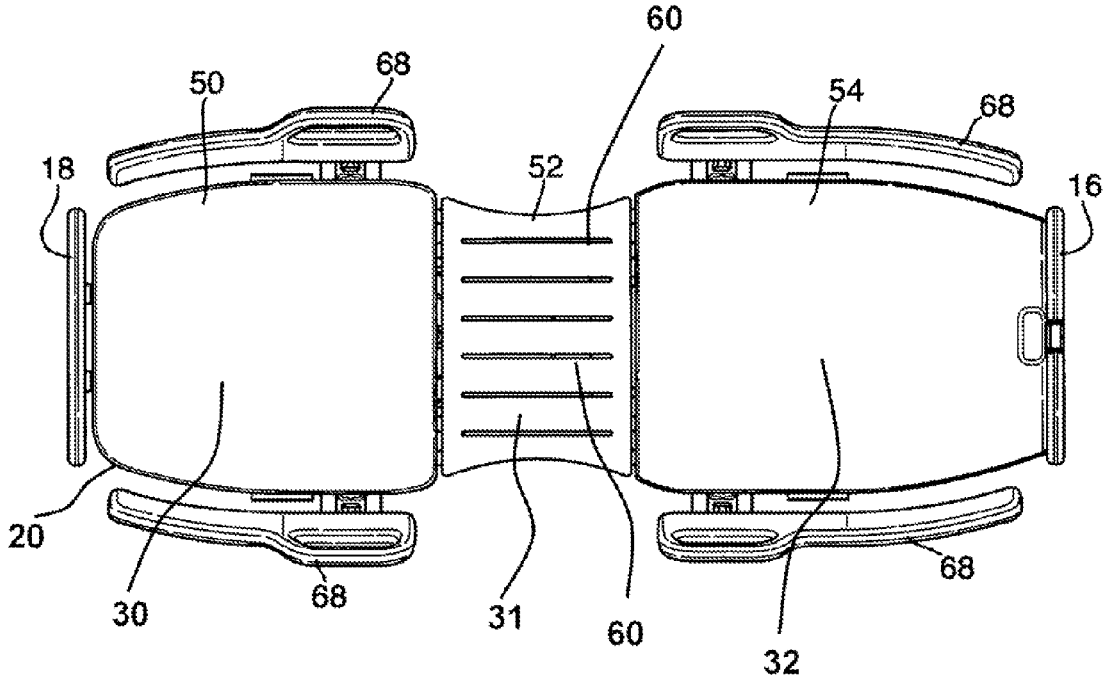
FIG. 5 is a top plan view of the platform according to the invention.

At least some of the mattress support panels 50, 52, 54 are preferably removable and advantageously made of injection mouldings from any suitable plastics material. The panels 50 and 54 may be rigid, but panel 52 is flexible and conforms to the shape of the person lying thereon. As shown in FIGS. 2, 4 and 5, cut outs 60 allow the panel 52 to flex under the weight of the patient. Instead of panel 52 with cut-outs, individual narrow slats arranged longitudinally or transversely in the seat section 31 may be used to perform the same function. Any other flexible material may be used. This flexing is advantageous because it allows a patient to be centered on the center panel 52 and makes the turning of the patient easier.

Figure 3:
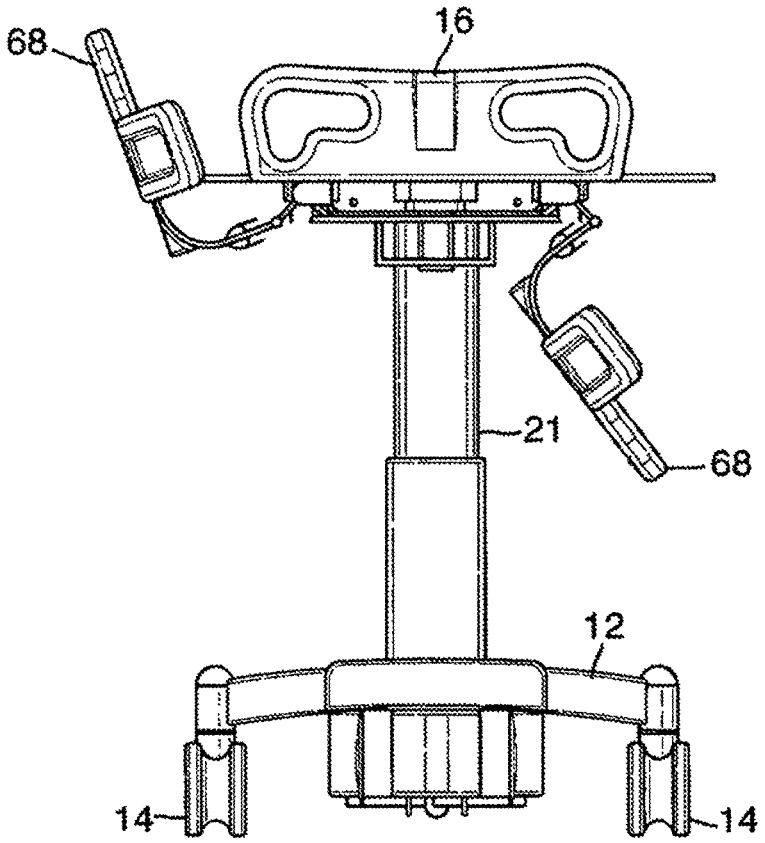
FIG. 3 is an end view of the stretcher in FIG. 2.

FIGS. 2 and 3 also show side barriers 68 coupled to the stretcher frame 22 at the foot end and head end of the stretcher. The side barriers 68 are typically made from a plastics material or from metal covered with a plastics cladding. There are two side barriers 68 on one side and corresponding side barriers 68 are provided on the other side of the stretcher platform 20. These side barriers 68, which can be of a type known in the art, can be moved between the raised position shown in FIG. 3, an extended position shown in FIGS. 2 and 3 and a lowered position in which they lie alongside the frame 22 so as to be below the level of the mattress 28 of the stretcher (as shown by one lowered side barrier in FIG. 3). In the raised position the side barriers 68 retain a patient on the stretcher and support the mattress 28 sides, while in the lowered position they enable a patient to get off or allow the patient to be transferred onto another bed and further provide unimpeded access to the patient. The extended position of the side barriers 68 allows for the stretcher to be used for larger patients. The shaped side barriers 68 are higher than side barriers in the prior art and provide a safer experience for the patient during turning.

Referring now to FIG. 4, the stretcher of FIG. 1 is shown with the back rest raised. The back rest 30 can be raised in the manner shown by means of one or more actuators provided in the stretcher assembly 10. The actuators are well known in the art, as is the type of control system used to control them, so they will not be described in further detail herein. In this configuration with the back rest 30 raised, the flexible seat section 31 allows a patient to sink into the seat section 31. This arrangement is advantageous because, when a person moves from a lying position to a sitting position the person stretches at the point of bending (that is between the patient's back and lower thighs) and the weight in this body region sinks the patient's buttocks into the seat section conforming the patient's body in this region to the seat section. Thus, this arrangement follows the extension of the person, and increases the effective length of the mattress support due to the flexible seat section 31, and therefore makes it much more comfortable to a patient and furthermore prevents the patient from slipping further down the stretcher, especially in the presence of soap and water during bathing. Prior art stretchers, with a flat rigid support surface, do not benefit from this increase in the effective length of the mattress support.

Referring now to FIG. 5, this shows the stretcher features of FIG. 2 in plan view with the frame 20 in a flat configuration. It can be seen that the provision of waisted support panel 52 provides good access to a patient, lying on the stretcher.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment.

The invention claimed is:

1. A shower stretcher comprising:

a frame supporting a platform and means to raise and lower said platform, the platform comprising:

a backrest section including a head end, a foot section including a foot end, and a seat section, wherein the seat section is constructed of flexible material that is more flexible than the backrest section and the foot section to conform more closely to the shape of a person lying thereon, and wherein the seat section includes a panel having a plurality of cutouts extending through an upper surface and a lower surface of the seat section or includes a plurality of slats forming openings therebetween extending through the upper and lower surfaces of the seat section such that a greater portion of a surface area of the seat section is substantially solid and a lesser portion of the surface area is open, respectively, through the plurality of cutouts or between the slats.

2. The shower stretcher of claim 1, wherein the seat section has concave sides to present a waisted surface when looking from above the stretcher.

3. The shower stretcher of claim 1, wherein the stretcher includes side barriers coupled to the stretcher frame at each head and foot end of the stretcher.

4. The shower stretcher of claim 3, further comprising a mattress including mattress sides extending upward from the platform, where the side barriers are arranged to move between a raised vertical position, a raised position extending outwards from the frame, and a lowered position in which the side barriers lie alongside the frame so as to be below the level of the mattress of the stretcher.

5. The shower stretcher of claim 3, wherein the side barriers have handles for maneuvering the stretcher sideways.

6. The shower stretcher of claim 3, wherein the side barriers comprise discontinuous head and foot side barriers.

7. An apparatus for use in bathing a person comprising:

a base;

a raiseable platform; and a frame;

wherein the platform comprises a backrest panel, a foot panel, and a seat panel between the backrest panel and the foot panel;

wherein the seat panel comprises one or more openings therein that extend through an upper surface and a lower surface of the seat panel and is substantially solid, wherein the seat panel comprises a more flexible surface relative to the backrest panel and the foot panel, the flexible surface formed of a material different than: (i) a material of the backrest panel; (ii) a material of the foot panel or (iii) the material of the backrest panel and the material of the foot panel, and wherein the seat panel is configured to conform to the shape of a person positioned thereon.

8. The apparatus of claim 7, wherein the backrest panel and the foot panel are rigid.

9. The apparatus of claim 7, wherein the seat panel is configured and arranged such that, upon application of weight to the seat panel, the effective length of the platform is increased.

10. The apparatus of claim 7, wherein the platform has a raised condition and a lowered condition where the seat panel is more flexible than the backrest panel and the foot panel in both the raised and lowered conditions.

11. The apparatus of claim 7, further including side barriers that extend along a side length of the backrest panel, the foot panel, or both.

12. The apparatus of claim 11, wherein the apparatus further comprises a water resistant mattress supported on the platform and positioned between the side barriers positioned on opposing sides of the platform.

13. The apparatus of claim 7, wherein the apparatus further comprises a column extending from the base and supporting the platform, wherein the column is capable of elevating and lowering the platform.

14. An apparatus for use in bathing a person comprising:

a stretcher comprising a platform;

a base supporting the stretcher;

wherein the platform comprises a head section, a mid section and a foot section, wherein the mid section includes a lesser surface area with openings therein that extend through an upper surface and a lower surface of the mid section and a greater surface area that is substantially solid, and wherein the mid section is constructed of material that is different and more flexible than: (i) a material of the head section; (ii) a material of the foot section; or (iii) the material of the head section and the material of the foot section and wherein the mid section is configured to flex upon application of weight to the mid section.

15. The apparatus of claim 14 wherein the head section, the mid section and the foot section are positionable to all lie in the same plane.

16. The apparatus of claim 14, wherein the plane in which the mid section lies is below the plane of the head section.

17. The apparatus of claim 14, wherein the head section and the foot section are rigid and the mid section is flexible.

18. The apparatus of claim 14, wherein the mid section is configured and arranged such that upon application of weight to the mid section the effective length of the platform is increased.

19. The apparatus claim 14, wherein the apparatus further comprises:

side barriers extending from opposing sides of the platform; and a mattress supported on the platform and positioned between the side barriers, wherein at least one side barrier is movable between a raised position and a lowered position in which at least a portion of the side barrier is located below the platform supported mattress.

20. The shower stretcher of claim 14, wherein the mid section has opposing concave sides configured to form a waist with respect to the adjoining head and foot sections.

* * * * *